US007921668B2

(12) United States Patent
Lee et al.

(10) Patent No.: US 7,921,668 B2
(45) Date of Patent: Apr. 12, 2011

(54) REFRIGERATOR HAVING CONTROLLED ICE MAKER AND DISPENSER

(75) Inventors: Seung Mok Lee, Gimhae-si (KR); Sam Kyu Park, Basan (KR)

(73) Assignee: LG Electronics Inc., Seoul (KR)

( * ) Notice: Subject to any disclaimer, the term of this patent is extended or adjusted under 35 U.S.C. 154(b) by 784 days.

(21) Appl. No.: 11/364,186

(22) Filed: Mar. 1, 2006

(65) Prior Publication Data

US 2006/0196214 A1 Sep. 7, 2006

(30) Foreign Application Priority Data

Mar. 2, 2005 (KR) ..... 10-2005-0017128
Mar. 7, 2005 (KR) ..... 10-2005-0018524

(51) Int. Cl.
*F25D 3/00* (2006.01)

(52) U.S. Cl. ..... 62/389; 62/66; 62/135; 62/340; 62/344; 62/353; 222/146.1; 222/146.6

(58) Field of Classification Search ..... 62/344, 62/135, 389, 340, 66, 353; 222/146.1, 146.6
See application file for complete search history.

(56) References Cited

U.S. PATENT DOCUMENTS 5,474,213 A * 12/1995 Unger ..... 222/108
6,651,449 B2 * 11/2003 Heims et al. ..... 62/98
6,735,959 B1 5/2004 Najewicz
7,188,479 B2 * 3/2007 Anselmino et al. ..... 62/66

FOREIGN PATENT DOCUMENTS

JP 2003-262438 9/2003
JP 2004-354037 12/2004
WO WO 03102481 A1 * 12/2003

OTHER PUBLICATIONS

Russian Office Action dated Sep. 10, 2009 (Russian text and English translation).

* cited by examiner

*Primary Examiner* — Cheryl J Tyler
*Assistant Examiner* — Justin Loffredo
(74) *Attorney, Agent, or Firm* — KED & Associates, LLP

(57) ABSTRACT

A refrigerator has a freezing chamber at the bottom, and a refrigerating chamber over the freezing chamber. The refrigerator includes an ice making unit and an ice dispenser mounted in a refrigerating chamber door that allows ice to be dispensed without opening the door. A sub-PCB is mounted in the refrigerating chamber door for controlling operations of the ice making unit and the dispenser. A cold air supply duct supplies cold air from a cold air supply unit to the ice making unit.

14 Claims, 7 Drawing Sheets

REFRIGERATOR HAVING CONTROLLED ICE MAKER AND DISPENSER

CROSS-REFERENCE TO RELATED APPLICATIONS

This application claims the benefit of Korean Application No. P2005-17128, filed on Mar. 2, 2005, and P2005-18524, filed on Mar. 7, 2005 which are hereby incorporated by reference as if fully set forth herein.

BACKGROUND OF THE INVENTION

1. Field of the Invention

The present invention relates to refrigerators, and more particularly, to a refrigerator in which a refrigerating chamber door which opens/closes a refrigerating chamber on an upper side thereof is provided with an ice maker and a dispenser.

2. Discussion of the Related Art

As known, a refrigerator, an appliance for storing food at a low temperature, stores food at a frozen state or a cold state depending on kinds of food. Cold air for the refrigerator is produced by repetitive performance of a refrigerating cycle of compression, condensation, expansion, and evaporation of the refrigerant, and the cold air is supplied to the refrigerator continuously. The cold air supplied to respective chambers of the refrigerator thus is delivered throughout an inside of the refrigerator uniformly by convection to cool down the chambers to predetermined temperatures respectively, so that food can be stored in the refrigerator at desired temperatures.

FIG. 1 illustrates a front view of a related art refrigerator with doors thereon opened.

Referring to FIG. 1, there is a refrigerator body 10 of a substantially hexahedral shape. There is an inside of the body 10 partitioned into a refrigerating chamber 20 for low temperature storage of food, and a freezing chamber 30 for frozen storage of food on an upper side and a lower side thereof, respectively. The refrigerating chamber 20 and the freezing chamber 30 have opened fronts, respectively. The fronts are opened/closed with refrigerating chamber doors 40, and a freezing chamber door 50.

The refrigerating chamber doors 40 are located at both a left side and a right side of the refrigerating chamber with edges thereof each rotatably hinged at the body 10 with hinge brackets 42. Accordingly, the user can rotate the refrigerating chamber doors 40 around the hinge brackets 42 in left/right directions, respectively, to open the front of the refrigerating chamber 20.

Though not shown, electric wires lead from the body 10 to an inside of one or both of the refrigerating chamber doors 40 through the hinge brackets 42, which is the only part that connects the refrigerating chamber doors 40 to the body 10. Accordingly, in one side of an upper part of one or both of the refrigerating chamber doors 40 there is a predetermined passage for placing the electric wires therein.

A variety of sizes and states of food are stored in the refrigerator. In order to store such food, in the refrigerating chamber 20, and on an inside the refrigerating chamber door 40, there are drawers, baskets, and shelves for holding various types of food.

On the lower side of the body 10, the freezing chamber door 50 slides in front/rear directions, to close the opened front of the freezing chamber 30. On an upper side of the freezing chamber door 50, there is a freezing chamber door handle 52 projected forward, for easy holding and moving the freezing chamber door by the user. In the freezing chamber 30, there are a plurality of drawers and baskets, for sorting and storing various kinds of food therein. Also, on one side of the freezing chamber 30, there is an ice maker 60 for production of ice.

The mounting of the ice maker 60 in the freezing chamber 30 on the lower side of the body 10 causes an inconvenience in use of the refrigerator in that the user must open the freezing chamber door 50 and bend over to take out the ice.

In order to resolve such a problem, a refrigerator is under study, in which the ice maker 60 is mounted to the refrigerating chamber 20 or the refrigerating chamber door 40, and an ice bank (not shown) which stores ice is mounted to the refrigerating chamber door 40 at a position opposite to the ice maker 60. However, if an ice maker 60 and the ice bank are mounted on the refrigerating chamber door 40, a separate evaporator and a cold air fan are required to supply cold air to the ice maker. Consequently, a number of extra components and working man-hours are required to make such a refrigerator, which results in poor productivity and a high production cost. Moreover, the mounting of additional components reduces a storage space of the refrigerating chamber 20 or the refrigerating chamber door 40.

If a plurality of electric devices and components, such as the ice maker 60, the ice bank, the dispenser (not shown), a display (not shown), and the like are provided to the refrigerating chamber door 40, it is necessary for a plurality of electric wires to be connected from a main PCB (not shown) in the body 10 to the electric components in the door. Because the plurality of electric wires that lead from a main PCB (not shown) can only be introduced into the refrigerating chamber door 40 through a predetermined space provided in the hinge bracket 42, which is the only part that connects the refrigerating chamber door 40 to the body 10, a size of the space for the wires is restricted by a size of the hinge bracket. Moreover, because the plurality of electric wires that are introduced into the refrigerating chamber door 40 must be connected to various electric components, the connection of the electric wires to the various electric components in the refrigerating chamber door 40 can be very difficult, with a poor workability.

SUMMARY OF THE INVENTION

Accordingly, the present invention is directed to a refrigerator that substantially obviates one or more problems due to limitations and disadvantages of the related art.

An object of the present invention is to provide a refrigerator which has an ice making chamber on one of the refrigerating chamber doors, but which also has simple components and structure for making and storing the ice. Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator embodying the invention includes a refrigerating chamber for storing food, a refrigerating chamber door for opening/closing the refrigerating chamber, an ice making chamber located in the refrigerating chamber door, an ice making unit in the ice making chamber for making ice, a dispenser at a front of the refrigerating chamber door for dispensing ice from the ice making chamber, and a sub-PCB mounted to the refrigerating chamber door for controlling operations of at least one of the ice making unit and the dispenser.

In another embodiment of the present invention, a refrigerator includes a body having a refrigerating chamber on an upper side for cold storage of food, and a freezing chamber on a lower side for frozen storage of food, a refrigerating chamber door for opening/closing the refrigerating chamber, a cooling system for supplying the cold air to the refrigerating chamber and/or the freezing chamber, an ice making chamber located in the refrigerating chamber door, and an ice making unit in the ice making chamber for making ice. In this embodiment, a cold air duct is configured to guide a portion of the cold air produced by the cooling system from the freezing chamber to the ice making chamber. This embodiment may also include a dispenser including a dispenser base recessed from a front of the refrigerating chamber door for forming a space for dispensing water or the ice, and a dispenser cover for covering a portion of a front of the dispenser base, to form an exterior of the front of the dispenser. Further, a sub-PCB may be mounted to the dispenser base for controlling operations of at least one of the ice making unit and the dispenser.

With a refrigerator embodying the invention, with an ice making chamber and dispenser located adjacent the refrigerating chamber, the user can take ice out of the refrigerator without opening/closing the refrigerating chamber door. Also, there is no need to bend over to open the freezer door at the bottom of the refrigerator.

The mounting of the sub-PCB in the refrigerating chamber door reduces a number of wires that need to be routed from the refrigerator body into the refrigerating chamber door. This allows the refrigerating chamber door to have electric devices and components of various functions provided thereto without changing or increasing a size of an electric wire inlet in the refrigerating chamber door.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
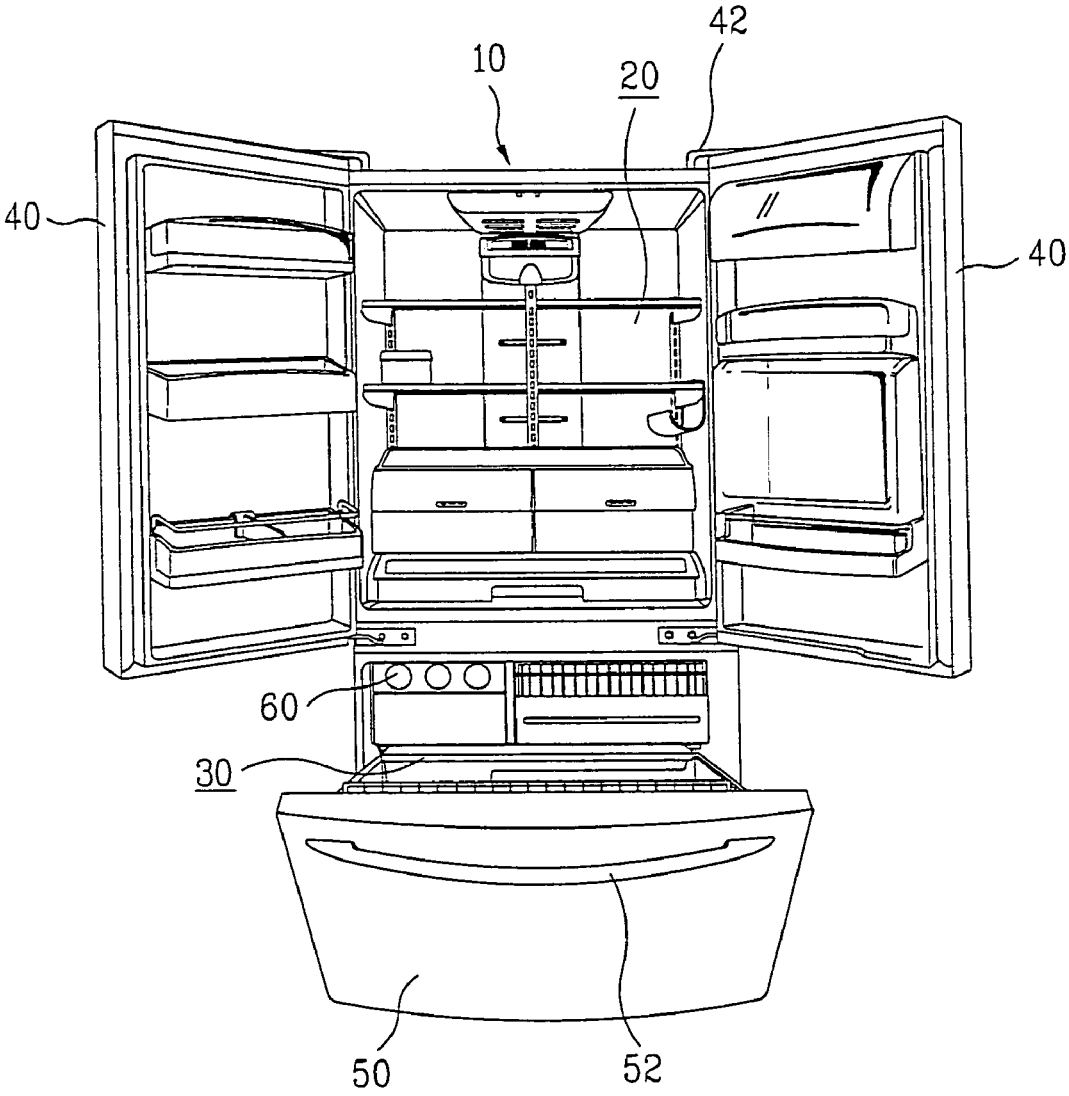
FIG. 1 Related Art
FIG. 1 illustrates a front view of a related art refrigerator, with doors thereon opened.
Figure 2:
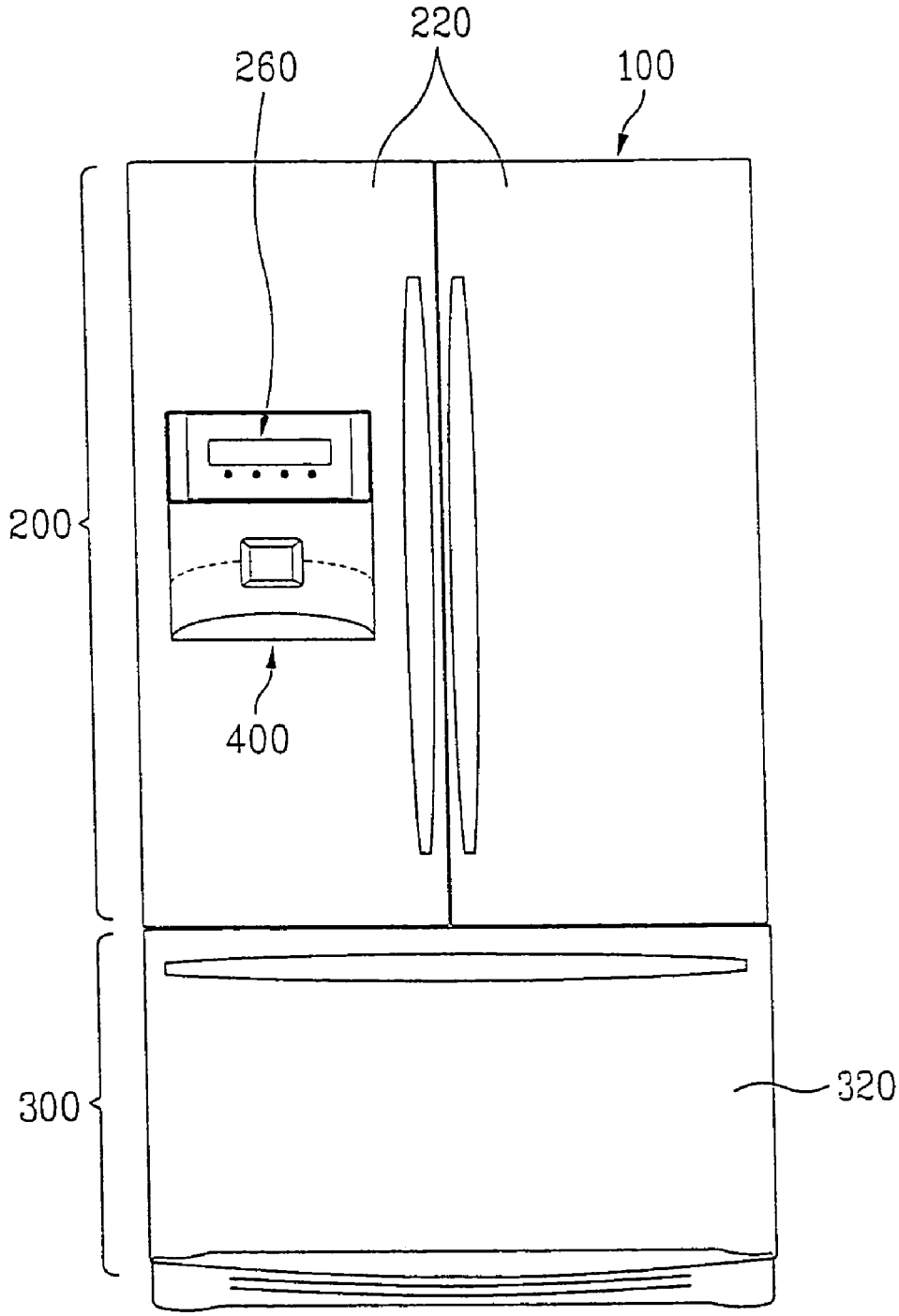
FIG. 2 illustrates a front view of a refrigerator in accordance with a preferred embodiment of the present invention.
Figure 3:
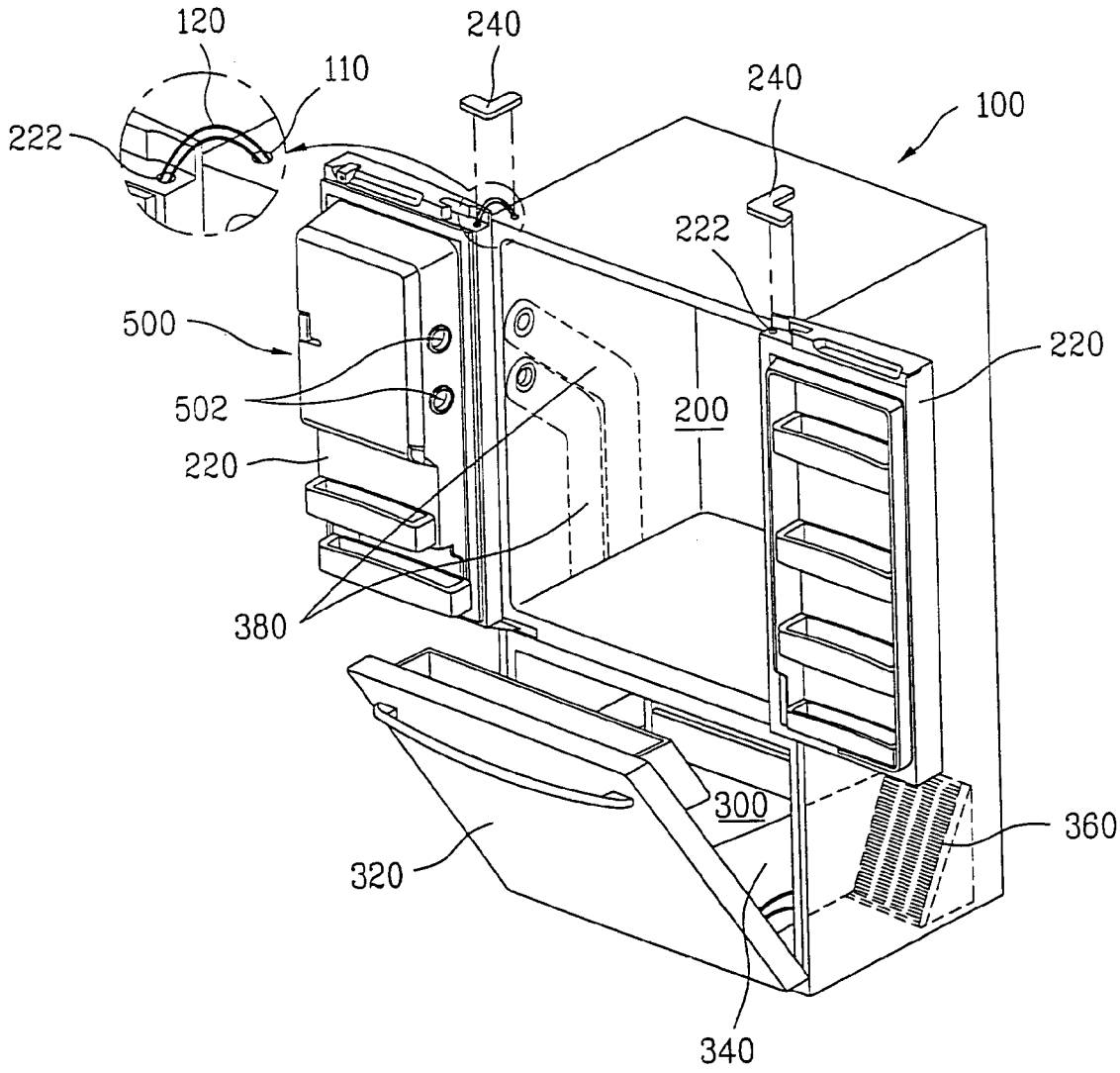
FIG. 3 illustrates a perspective view of the refrigerator in FIG. 2, with doors opened.

Referring to FIGS. 2 and 3, a body 100 of the refrigerator of the present invention has hexahedral shape, substantially, and an inside of the refrigerator is partitioned into a refrigerating chamber 200 and a freezing chamber 300. The refrigerating chamber 200 is on an upper side of the body 100. Though not shown, in the refrigerating chamber 200, there are various shapes of baskets, drawers, and shelves for effective holding of various kinds of food.

A flow of cold air in the refrigerating chamber 200 is influenced by the baskets, shelves, and drawers, causing restriction or regulation of convection of the cold air. The user can store various kinds of food at appropriate positions according to temperature characteristics caused by differences of the cold air supply. The refrigerating chamber 200 has an opened front which is opened/closed with refrigerating chamber doors 220. The refrigerating chamber doors 220 are mounted at left/right sides of the body 100, with left/right side edges thereof rotatably secured to opposite sides of the body 100 with hinge brackets 240, respectively. Accordingly, the refrigerating chamber doors 220 turns around the hinge bracket 240 to open the front of the refrigerating chamber 200.

Electric wires 120 lead from a main PCB in the body 100 into one or both of the refrigerating chamber doors 220 through the hinge bracket 240, which is only part that connects the body 100 to the refrigerating chamber door 220.

In more detail, one end of the hinge bracket 240 is fixed to one side end of a top surface of the refrigerating chamber door 220, i.e., an inside end thereof adjacent to the body 100. The other end of the hinge bracket 240 is fixed to an opposite side corner of a front edge of a top side of the body 100. According to this, the refrigerating doors 220 on left/right sides of the front of the body 100 turn around the hinge brackets 240.

In left/right side corners of a front edge of the top side of the body 100, having the hinge brackets 240 attached thereto, there are wire outlets 110 for pass through of the electric wires 120 for supplying power to the electric devices and components in the refrigerating chamber door 220. In one side end of the top side of the refrigerating door 220 having the hinge bracket 240 attached thereto, there are wire inlets 222 for pass through of the wires 120. Therefore, the wires 120 pass from the inside of the body 100 into an inside of the refrigerating chamber door 220 through the wire outlets 110 and the wire inlets 222. The wire inlet 222 has a structural size restriction due to a shape of the top side of the refrigerating chamber door 220. The wire inlet 222 is formed at an appropriate size taking a size of the hinge bracket 240 into account.

Provided in one of the left/right side refrigerating chamber doors 220, there are an ice making chamber 500 for making ice, and a dispenser 400 for dispensing purified water or ice. On one side of the dispenser 400, there are a display 480 and operation buttons 490 for temperature control of an inside of the body 100 and display of a state.

Of the left/right side refrigerating chamber doors 220, the other side refrigerating chamber door 220 having no dispenser 400 mounted thereto may be provided with a home bar (not shown) which enables the user to take out beverages which are taken out frequently from an outside of the refrigerating chamber without opening the refrigerating chamber door 220, additionally.

Under the refrigerating chamber 200, i.e., on the lower side of the body 100, there is a freezing chamber 300. The freezing chamber 300, for frozen storage of fish, meat, or food which requires a long time storage, has drawers, baskets, and the like therein for frozen storage of food depending on sizes and states of the food. On front of the freezing chamber 300, there is a freezing chamber door 320 for closing the freezing chamber 300. The freezing chamber door 320 is hinged along its lower edge. A storage box 340 which stores food, is slidable in front/rear directions, so as to be pulled out/pushed in the freezing chamber 300 together with the freezing chamber door 320.

On a rear side of the freezing chamber 300, there is a freezing chamber evaporator 360. The freezing chamber evaporator 360 absorbs heat from an outside of the evaporator 360 to produce cold air as refrigerant therein exchanges heat with external air. The cold air is introduced to the freezing chamber 300 from the freezing chamber evaporator 360, to drop a temperature of the freezing chamber 300.

On one side of the body 100, there is one or more cold air ducts 380 for supplying a portion of the cold air from the freezing chamber evaporator 360 to the ice making chamber 500 in the refrigerating chamber door. The cold air ducts 380 have one end in communication with an inside of the refrigerating chamber 200, so that the one end is connected to cold air supply holes 502 at one side of the ice making chamber 500. This allows cold air to be delivered into the ice making chamber 500 when the refrigerating chamber door 220 is closed. At one side of the freezing chamber 300, there is a cold air supply fan (not shown), for forced supply of the cold air from the freezing chamber evaporator 360 to the ice making chamber 500 through the cold air ducts 380.

Because the cold air ducts 380 are mounted on an inside of one side wall of the refrigerating chamber 200, heat is liable to be exchanged through the wall of the refrigerating chamber when the cold air flows through the cold air ducts 380. Therefore, it is preferable that heat insulating material is filled between the wall of the refrigerating chamber 200 and the cold air duct 380, for preventing a temperature of the refrigerating chamber 200 from being influenced by the cold air being supplied through the cold air ducts 380.

Figure 4:
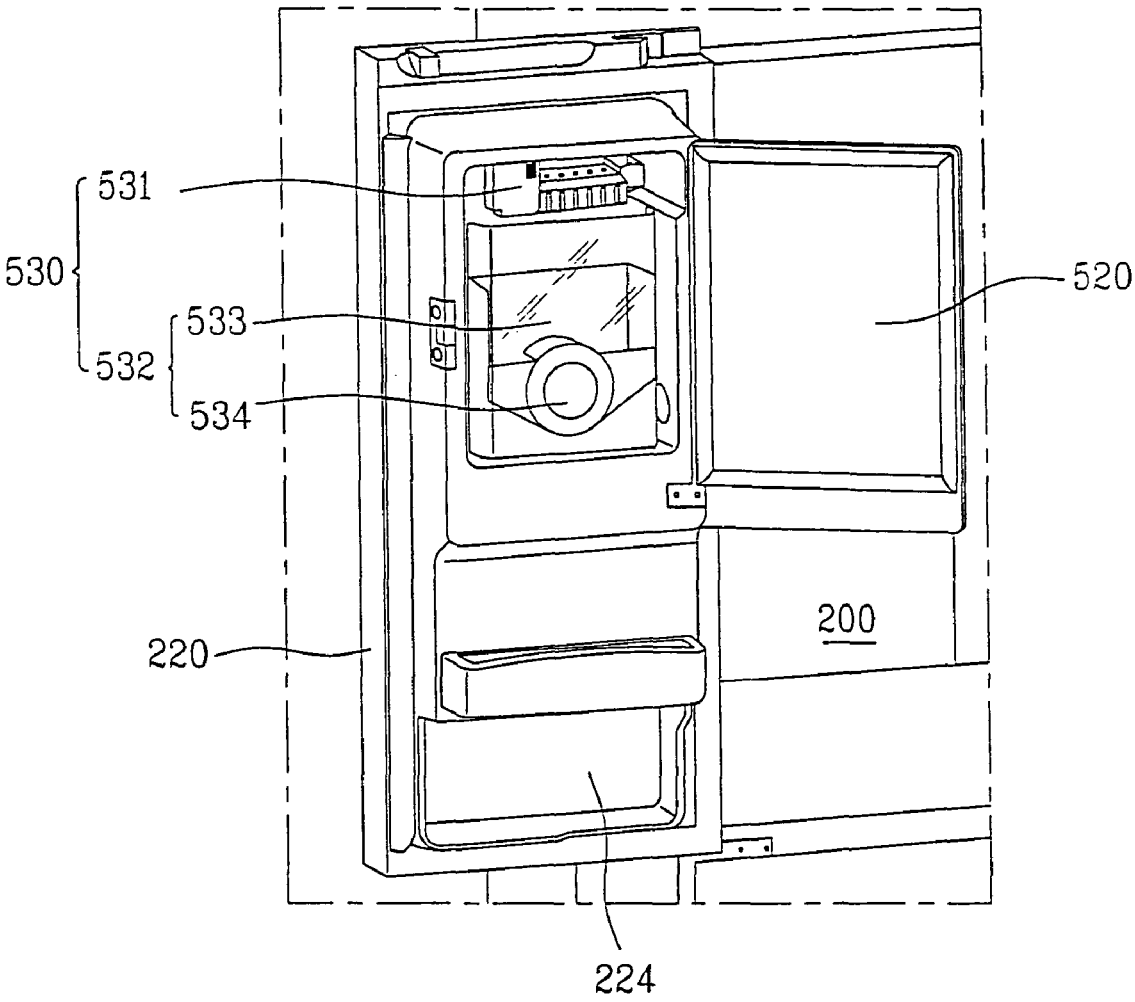
FIG. 4 illustrates a perspective view of an ice making chamber in the refrigerator in FIG. 2, with a door thereon opened, schematically.

Referring to FIG. 4, the ice making chamber 500 is provided to an inside of one of the left/right side refrigerating chamber doors 220 which close the opened front of the refrigerating chamber 200. The ice making chamber 500, a separate space for making ice, is opened/closed with an ice making chamber door 520 rotatably mounted to one side edge of the ice making chamber 500. As described before, the ice making chamber 500 has one side to be brought into contact with one side wall of the refrigerating chamber 200 such that the cold air supply hole 502 is connected to the cold air ducts 380.

In the ice making chamber 500, there is an ice making unit 530 for making and storing ice. The ice making unit 530 includes an ice maker 531 on an upper side of inside of the ice making chamber 500 for making ice, and an ice bank 532 under the ice maker 531 for storing and transferring the ice made. The ice maker 531 has the cold air supplied thereto through the cold air ducts 380 which heat exchanges with water in the ice maker 531 to make ice. The ice bank 532 stores ice made at the ice maker 531, and transfers the ice to the dispenser 400 so that the user can take the ice from the dispenser 400 (see FIG. 2) as the user desires. For this, the ice bank 532 includes a storage case 533 for storing the ice made at the ice maker 531, and an ice transferor 534 for guiding the ice from the storage case 533 to an ice outlet 450 (see FIG. 5) in communication with the dispenser 400. The storage case 533, which is under the ice maker 531, has a box shape having a width the same with an left/right side width of the ice making chamber 500. The ice transferor 534 is mounted at a center of a lower side of the storage case 533 for easy guidance of the ice to the ice outlet 450 (see FIG. 5). In order to guide a fixed number of pieces of the ice to the ice outlet from the storage case 533, the ice transferor 534 is provided with a rotating device, such as a step motor (not shown). It is preferable that an amount of rotation of the step motor is controlled according to handling of the dispenser 400. The ice transferor 534 may be integrated to the storage case 533, or independent from the storage case 533 and mounted in the ice making chamber 500 as required.

Because the cold air is introduced to the ice making chamber 500 from the freezing chamber evaporator 360 through the cold air ducts 380, no separate evaporator and fan are provided to the ice making chamber 500 or to the refrigerating chamber door 220 having the ice making chamber 500 provided thereto.

Figure 5:
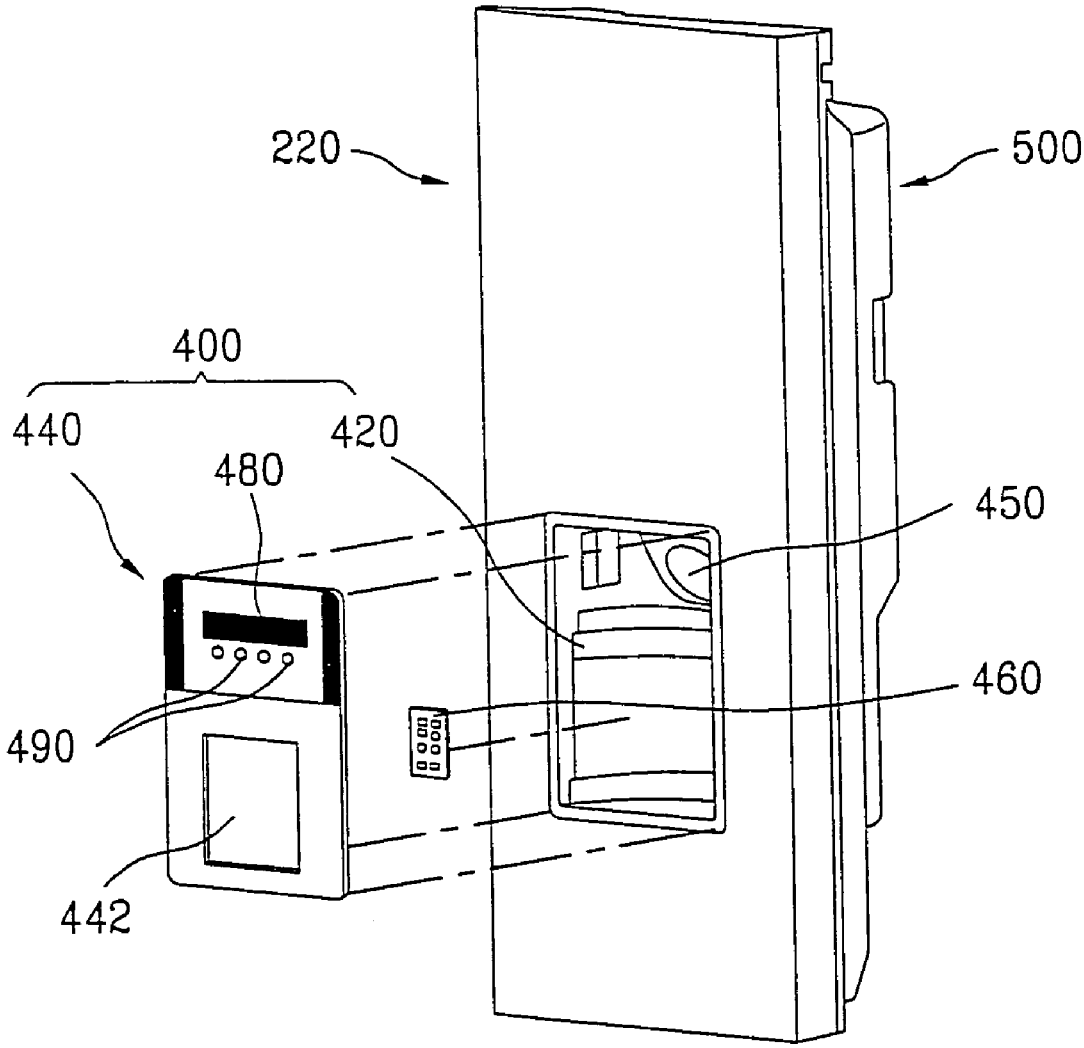
FIG. 5 illustrates an exploded perspective view of an inside of dispenser in a refrigerating chamber door of the refrigerator in FIG. 2, schematically.

Referring to FIG. 5, the dispenser 400 includes a dispenser base 420 and a dispenser cover 440. The dispenser base 420 is cavity recessed backward by a predetermined depth from a front of the refrigerating chamber door 220, so that the user can receive water or ice with a cup the user is holding at the time the user takes water or ice.

Though not shown, the dispenser 400 can include a plurality of electric outfits, such as a lamp for lighting an inside of the dispenser 400, a motor for opening/closing an ice or water outlet, a solenoid valve, a handling lever, and so on. Over the dispenser 400 is a display 480 for displaying an operation state of the dispenser 400 or the refrigerator, and a plurality of operation buttons 490 for operating the dispenser 400. If required, the operation buttons 490 of the display 480 may be mounted on the dispenser cover 440.

At one side of the dispenser 400 there is a sub-PCB 460 for controlling a plurality of electric devices and components including the ice maker 531. The sub-PCB 460 plays a role in controlling the operation of the various electric devices in the refrigerating chamber door 220, including at least one of the ice making unit 530 and the dispenser 400. That is, the sub-PCB 460 controls all or some of the ice making unit 530, the ice transferor 534, and a plurality of electric components of the dispenser 400.

The sub-PCB 460 has power supplied thereto through the electric wire 120 routed from the body 100 into the top of the door 220. The sub-PCB 460 controls the electric devices and components at the refrigerating chamber door 220 separate from a main PCB (not shown) mounted in the body 100.

It is preferable that the sub-PCB 460 is mounted on a rear of the dispenser base 420 or at a portion hidden by the dispenser cover 440. Though the sub-PCB 460 is shown as mounted to the dispenser base 420 in this embodiment, the sub-PCB 460 may also be mounted in a foam of the refrigerating chamber door 220, or an inside of the ice making chamber 500 or to the dispenser cover 440.

The dispenser cover 440 is mounted on an opened front of the dispenser base 420 to hide a portion of the dispenser base 420 and form an exterior of the dispenser 400. It is preferable that the dispenser cover 440 has a shape that harmonizes with the front of the refrigerating chamber door 220. For an example, the dispenser cover 440 may have a color that harmonizes with a color of the refrigerating chamber door 220, or the same with the refrigerating chamber door 220. Moreover, it is preferable that the dispenser cover 440 has a surface flush with the front surface of the refrigerating chamber door 220.

Most of the electric devices and components provided to the dispenser base 420 are hidden by the dispenser cover 440. The dispenser cover 440 has an opening 442 in a center for the user to put a cup or a bottle into a space of the dispenser base 420 for taking out water or ice.

Upon application of power to the refrigerator body 100, the electric devices and components in the body 100 start to operate. The operation of the electric devices and components produces cold air as the refrigerant flowing in the freezing chamber evaporator 360 in the body 100 heat exchanges with air. The cold air is supplied to the freezing chamber 300 and the refrigerating chamber 200, to drop temperatures of the freezing chamber 300 and the refrigerating chamber 200 down to temperatures proper to store food, respectively. In this instance, a portion of the cold air produced at the freezing chamber evaporator 360 is supplied to the ice making chamber 500 along one of the cold air ducts 380. The cold air supplied to the ice making chamber 500 is supplied to the ice maker 531. The cold air supplied to the ice maker 531 heat exchanges with water held at the ice maker 531, to make ice in the ice maker 531 in the ice making chamber 500. An ice making rate and amount is dependent on a rate of the cold air supplied thereto from the freezing chamber evaporator 360. The cold air having heat exchanged at the ice making chamber 500 is directed back toward the freezing chamber evaporator 360 along a return cold air duct 380.

The ice made as the water held at the ice making chamber 500 heat exchanges with the cold air supplied from the freezing chamber evaporator 360 is stored in the storage case 533 in the ice bank 532. If the user puts a cup or a bottle in the opening 442 of the dispenser 400, and operates a switch or an operation button 490 for taking out ice, the ice transferor 534 is put into operation under the control of the sub-PCB 460. The ice transferor 534 operates to supply ice, as required, to the dispenser under the control of the sub-PCB 460. The ice is discharged through the ice outlet 450 in the dispenser 400 as the ice outlet 450 is opened under the control of the sub-PCB 460. If required, the lamp (not shown) in the dispenser 400 may be turned on. Of course, the turn on of the lamp is also controlled by the sub-PCB. The ice discharged through the ice outlet 540 of the dispenser 400 is filled in a container the user holds. In this instance, a state of the ice making chamber 500 is displayed on the display 480, referring to which the user can carry out taking the ice.

By operating one of the operation buttons 490, a rate of the cold air supplied to the ice maker 531 can be controlled, to control the ice making rate, and a discharge rate and amount of ice through the ice transferor 534 can be controlled. All the operations of the electric components of the ice maker 531, the ice transferor 534, and the dispenser 400 may be controlled by the sub-PCB 460.

Figure 6:
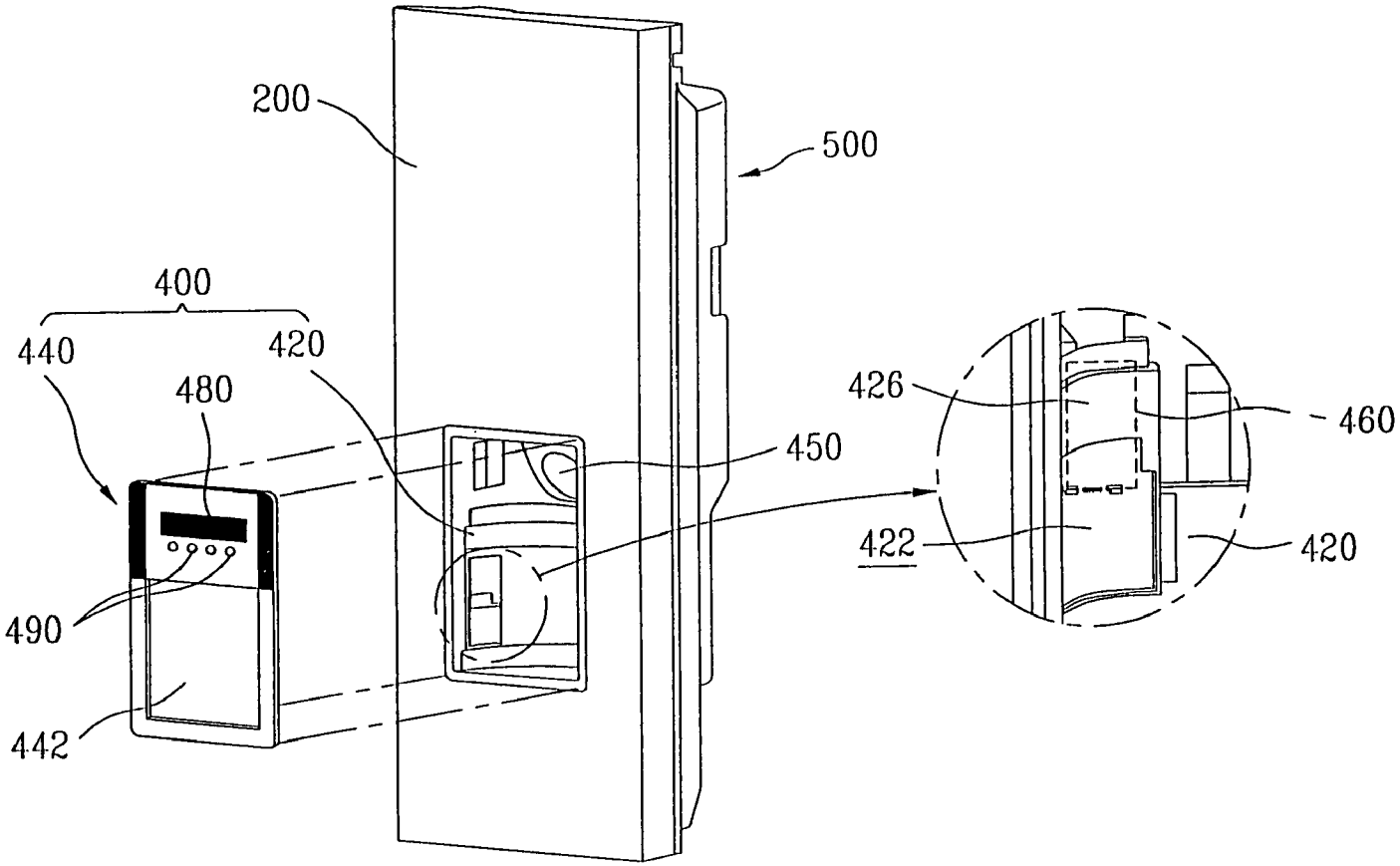
FIG. 6 illustrates an exploded perspective view of an inside of dispenser in a refrigerating chamber door of a refrigerator in accordance with another preferred embodiment of the present invention.
Figure 7:
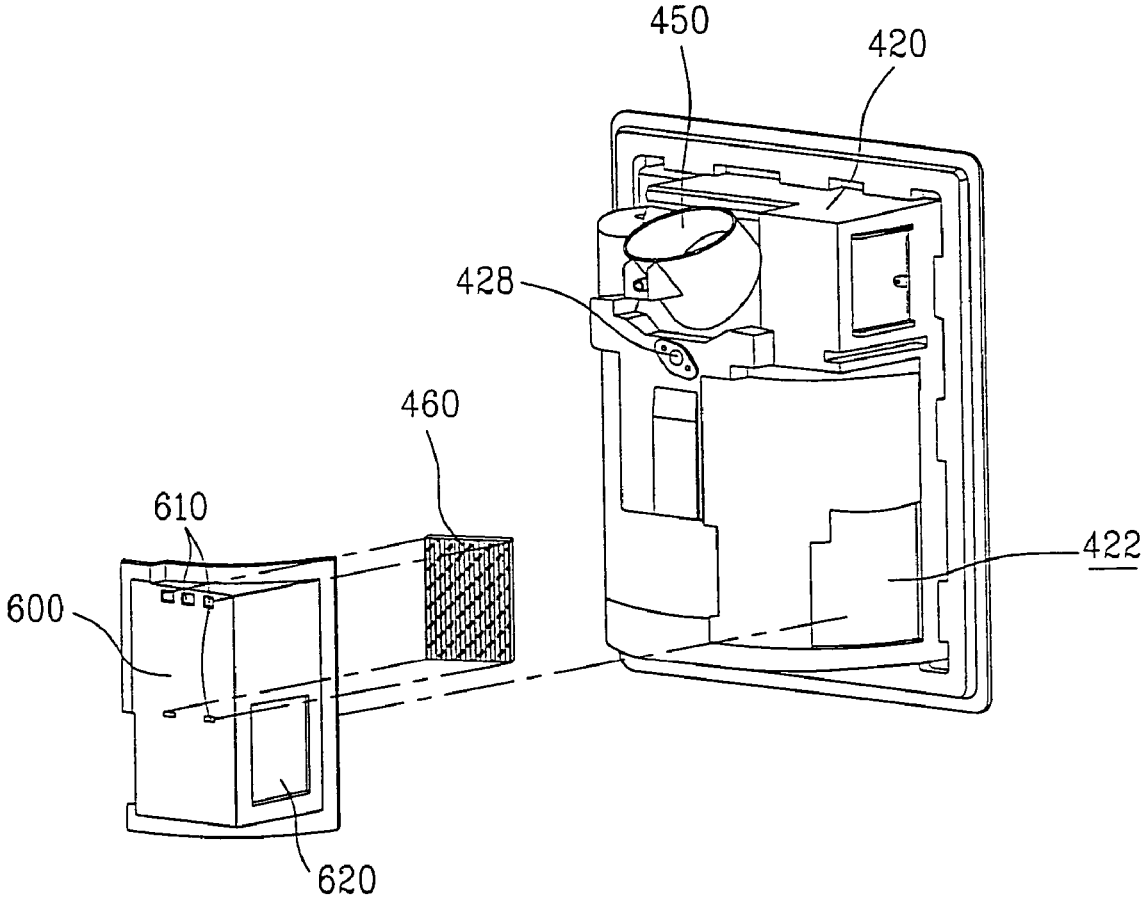
FIG. 7 illustrates an exploded, perspective, rear side view of the dispenser in FIG. 6.

FIGS. 6 and 7 illustrate an example of a structure in which the sub-PCB is mounted to the dispenser. As described before, the dispenser 400 includes the dispenser cover 440 and the dispenser base 420. Moreover, the dispenser cover 440 has the display 480 and the operation buttons 490, and the opening 442 in a center. Over the dispenser base 420, there are the ice outlet 450 for discharging ice from the ice bank 532 (see FIG. 4), and a water outlet 428 for discharging purified water. The dispenser base 420 has a hole 422 on one side of a lower side. In right rear of the hole 422, there is a sub-PCB supporter 600 having the sub-PCB 460 mounted thereon for controlling operation of the various components of the ice maker 531 (FIG. 4), the ice transferor 534 (see FIG. 4), and the dispenser 400.

As described before, the sub-PCB 460 has power supplied thereto from the electric wire passing into the door from refrigerator body. Independent from the main PCB (not shown) provided to the refrigerator body, the sub-PCB 460 can control the various electric devices and components provided to the refrigerating chamber door 220. Alternatively, it may be possible that the sub-PCB controls the electric devices and the components interlocked with the main PCB.

On an upper side and the middle of the front of the PCB supporter 600, there are a plurality of supporting members 610 for inserting and supporting the upper side and a lower side of the sub-PCB 460. Therefore, when the sub-PCB 460 is mounted to the PCB supporter 600, the sub-PCB 460 is positioned on the upper side of the PCB supporter 600. The reference numeral 620 denotes a pass through hole for pass through of electric wires which connect the sub-PCB 460 to various electric devices, such as the ice maker 531, the ice bank 532, the dispenser, and so on.

The hole 422 in the dispenser base 420 is large enough so that the sub-PCB can pass through the hole 422 from front of the dispenser base 420. It is preferable that a top edge of the PCB-supporter 600 is positioned higher than a top edge of the hole 422. That is, it is preferable that the PCB-supporter 600 is formed such that an upper side of the PCB-supporter 600 is shaded by the dispenser base 420. Accordingly, when the sub-PCB 460 is mounted to the PCB supporter 600 through the hole 422, most of the sub-PCB 460 is shaded by an upper side of the hole 422 except a portion of a lower side of the sub-PCB 460. That is, the upper side of the hole 422 of the dispenser base 420 is a hiding portion 426 for hiding the upper side of the sub-PCB 460.

The hiding portion 426 has a curved shape. Sides of the PCB supporter 600 have shapes in conformity with surfaces of the dispenser base 420 such that the sides of the PCB supporter 600 are in close contact with the surfaces of the dispenser base 420. An inner portion of the PCB supporter 600 has a shape in which two planes substantially perpendicular to each other are recessed backward. According to this, between the sub-PCB 460 mounted to the PCB supporter 600 and the hiding portion 426, there is a gap of a predetermined distance.

This configuration of the sub-PCB mounting structure prevents the sub-PCB 460 from becoming wet with water or ice being dispensed through the dispenser 400, which helps to prevent the sub-PCB 460 from malfunctioning or going out of order. That is, at the time water or ice is dispensed through the ice outlet 450 or the water outlet 428 of the dispenser 400, the ice or the water is liable to splash. However, most of the sub-PCB 460 is shaded by the hiding portion 426 of the dispenser base 420, so that wetting or permeating of the sub-PCB 460 with water can be prevented. The gap between the sub-PCB 460 and the hiding portion 426 of the dispenser base 420 prevents the sub-PCB 460 from being permeated with water even if water flows down along a front of the dispenser base 420.

As has been described, the refrigerator of the present invention allows ice to be made at an ice making chamber in the refrigerating chamber door. The user can then take the ice from a dispenser mounted to the refrigerating chamber door. According to this, convenience of the refrigerator is improved as the user can take a desired amount of ice with a simple operation of the dispenser at the refrigerating chamber door on an upper side of the refrigerator without bending over and opening/closing the freezing chamber door.

The ice making with cold air from the freezing chamber evaporator eliminates the need for a separate evaporator and fan and motor in the ice making chamber. This, in turn, frees up more storage space and reduces the cost and complexity of the refrigerator.

Moreover, the sub-PCB is mounted to the refrigerating chamber door, i.e., at one side of the dispenser, for controlling operations of the plurality of electric devices and components required for the easy taking out of the ice from an outside of the refrigerator through the dispenser. According to this, the number of wires passing from the body into the refrigerating chamber door can be reduced significantly. This means that a refrigerating chamber door that is provided with electric devices and components which have various functions can be designed without being influenced by a size of the wire inlet in the refrigerating chamber door. Moreover, though lengths of wires are very long if the various electric components of the ice maker, the ice bank, and the dispenser are connected to the main PCB, the length of wires become significantly shorter if the various electric components of the ice maker, the ice bank, and the dispenser are connected to the sub-PCB in the refrigerating chamber door.

The mounting of the sub-PCB in the door can be easily accomplished by inserting the sub-PCB into the door through an opening in the dispenser. Also, by ensuring that the sub-PCB is mounted sufficiently high up on the door helps to prevent the sub-PCB from being damaged by water or ice that is being dispensed from the door.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator, comprising:

a main body having a refrigerating chamber and a freezing chamber formed therein, the refrigerating chamber being positioned atop the freezing chamber;

a refrigerating chamber door for opening/closing the refrigerating chamber;

an ice making assembly installed in the refrigerating chamber door;

a dispenser located on a front of the refrigerating chamber door for dispensing ice from the ice making assembly, the dispenser including:

a dispenser base positioned in a recess formed in the front of the refrigerating chamber door so as to define a space at which water or ice is dispensed, wherein the dispenser base comprises:

an upper wall having an ice outlet and a water outlet formed therein;

a vertical wall that extends vertically downward from an outer peripheral edge of the upper part, the vertical wall being substantially parallel to the front of the refrigerating chamber door and having an exterior side that faces an exterior of the refrigerator and an interior side that faces an interior of the refrigerating chamber door; and a bottom wall that extends horizontally from a bottom peripheral edge of the vertical wall, wherein the vertical wall has a rounded contour that extends rearward from an open front face of the dispenser base;

a dispenser cover that extends along a peripheral portion of the open front face of the dispenser base, the dispenser cover including a display configured to indicate an operation state of at least one of the ice making assembly, the dispenser, or the refrigerator; and a sub-PCB installed on the interior side of the vertical wall of the dispenser base such that the dispenser base shields the sub-PCB from water or ice being dispensed from the dispenser, wherein the sub-PCB controls operation of at least one of the ice making assembly or the dispenser.

2. The refrigerator as claimed in claim 1, wherein the ice making assembly includes an ice maker and an ice bank for storing ice made by the ice maker.

3. The refrigerator as claimed in claim 1, wherein there is a predetermined gap between corresponding surfaces of the sub-PCB and the dispenser base such that liquids or ice being dispensed from the dispenser will not contact the sub-PCB.

4. The refrigerator as claimed in claim 1, further comprising a PCB supporter mounted on the interior side of the vertical wall of the dispenser base.

5. The refrigerator as claimed in claim 4, wherein an aperture is formed in the dispenser base adjacent the PCB supporter such that the sub-PCB can be inserted through the aperture and installed on the interior side of the vertical wall of the dispenser base by the PCB supporter.

6. The refrigerator as claimed in claim 4, wherein the sub-PCB is mounted to the PCB supporter to prevent liquids and/or ice from contacting the sub-PCB.

7. The refrigerator as claimed in claim 4, wherein the PCB supporter comprises:

a mounting portion that is recessed backward from dispenser, wherein the mounting portion has a flat surface for mounting the sub-PCB; and a plurality of supporting members that project from the mounting portion, wherein the plurality of supporting members are configured to hold edges of the sub-PCB.

8. The refrigerator as claimed in claim 1, further comprising a cold air duct configured to guide cold air from a cold air supply unit to the ice making assembly.

9. The refrigerator as claimed in claim 8, wherein the cold air supply duct supplies cold air from an evaporator located adjacent the freezing chamber to an outlet aperture in the refrigerating chamber that is adjacent the refrigerating chamber door.

10. The refrigerator as claimed in claim 9, wherein an inlet aperture is formed in the refrigerating chamber door such that the inlet aperture abuts the outlet aperture when the refrigerating chamber door is closed, and wherein the inlet aperture allows cold air from the cold air supply duct to be delivered to the ice making assembly.

11. The refrigerator as claimed in claim 1, further comprising:

a first passage that extends from a cold air supply device positioned adjacent to the freezing chamber, along a side wall of the refrigerator, and to the ice making assembly so as to supply cold air to from the cold air supply device to the ice making assembly; and a second passage that extends from the ice making assembly, along the side wall of the refrigerator and to the cold air supply device so as to return air from the ice making assembly to the cold air supply device, wherein an outlet of the first passage is aligned with an inlet into the ice making assembly and an outlet of the ice making assembly is aligned with an inlet into the second passage when the refrigerating chamber door is closed.

12. The refrigerator as claimed in claim 11, wherein the outlet of the first passage and the inlet of the second passage are each formed in a side wall of the refrigerating chamber aligned with corresponding openings into the ice making assembly.

13. The refrigerator as claimed in claim 1, wherein the sub-PCB is positioned at a predetermined horizontal distance away from the interior side of the vertical wall the dispenser base such that liquids or ice being dispensed form the dispenser do not contact the sub-PCB.

14. The refrigerator as claimed in claim 13, wherein the sub-PCB is located at a position that is lower than the display and one of the ice outlet or the water outlet.

* * * * *